US009976256B2

(12) United States Patent
Kajanto et al.

(10) Patent No.: US 9,976,256 B2
(45) Date of Patent: May 22, 2018

(54) METHOD FOR MAKING NANOFIBRILLAR CELLULOSE AND FOR MAKING A PAPER PRODUCT

(71) Applicant: UPM-KYMMENE CORPORATION, Helsinki (FI)

(72) Inventors: Isko Kajanto, Espoo (FI); Taisto Tienvieri, Vantaa (FI); Juha Tamper, Taipalsaari (FI)

(73) Assignee: UPM-KYMMENE CORPORATION, Helsinki (FI)

( * ) Notice: Subject to any disclaimer, the term of this patent is extended or adjusted under 35 U.S.C. 154(b) by 138 days.

(21) Appl. No.: 14/891,222

(22) PCT Filed: May 15, 2014

(86) PCT No.: PCT/FI2014/050367

§ 371 (c)(1),
(2) Date: Nov. 13, 2015

(87) PCT Pub. No.: WO2014/184442

PCT Pub. Date: Nov. 20, 2014

(65) Prior Publication Data

US 2016/0122947 A1 May 5, 2016

(30) Foreign Application Priority Data

May 15, 2013 (FI) ..... 20135521

(51) Int. Cl.
*D21H 23/16* (2006.01)
*D21H 11/18* (2006.01)
(Continued)

(52) U.S. Cl.
CPC ..... *D21H 11/20* (2013.01); *D21H 11/18* (2013.01); *D21H 21/02* (2013.01); *D21H 23/16* (2013.01)

(58) Field of Classification Search
CPC ..... D21H 1/18; D21H 11/20; D21H 11/22; D21H 11/10; D21H 23/16; D21H 23/04;
(Continued)

(56) References Cited

U.S. PATENT DOCUMENTS 4,100,341 A 7/1978 Brasey et al.
6,824,645 B2 11/2004 Jaschinski et al.
(Continued)

FOREIGN PATENT DOCUMENTS

CN 101874043 A 10/2010
CN 102317542 A 1/2012
(Continued)

OTHER PUBLICATIONS

Kutcharlapati et al., "Infulence of Nano Cellulose Fibres on Portland Cement Matrix," Metals Materials and Processes, 2008, vol. 20, No. 3, pp. 307-314.
(Continued)

*Primary Examiner* — Eric Hug
(74) *Attorney, Agent, or Firm* — Nixon Peabody LLP

(57) ABSTRACT

A method for making nanofibrillar cellulose includes mixing anionized or cationized cellulose fibers and cellulose pulp to a mixture including at least 1% and below 90 wt-% cellulose pulp based on dry weight, and subjecting the mixture to a refiner stage where the anionized or cationized cellulose fibers are at least partly reduced to nanofibrillar cellulose and the cellulose pulp acts as auxiliary pulp, and obtaining a mixture of nanofibrillar cellulose and cellulose pulp from the refining stage. The mixture can be used for making paper by adding it to base pulp.

19 Claims, 4 Drawing Sheets

(51) Int. Cl.
*D21H 11/20* (2006.01)
*D21H 21/02* (2006.01)

(58) Field of Classification Search
CPC ..... D21H 23/06; D21H 23/14; D21H 1/08; D21H 11/16; D21D 1/00; D21D 1/004; D21D 1/20; D21B 1/16
USPC ..... 162/146, 157.6
See application file for complete search history.

(56) References Cited

U.S. PATENT DOCUMENTS

| | | | | |
|---|---|---|---|---|
| 2002/0098317 | A1 | 7/2002 | Jaschinski et al. | |
| 2005/0272836 | A1 | 12/2005 | Yaginuma et al. | |
| 2010/0233481 | A1 | 9/2010 | Isogai et al. | |
| 2013/0005869 | A1* | 1/2013 | Yano | C08B 11/145 524/43 |
| 2014/0182797 | A1 | 7/2014 | Paltakari et al. | |
| 2014/0238626 | A1* | 8/2014 | Tsuji | C08B 15/02 162/72 |
| 2016/0060815 | A1* | 3/2016 | Heiskanen | D21H 11/18 162/9 |

FOREIGN PATENT DOCUMENTS

| | | | |
|---|---|---|---|
| JP | 2009243010 | A | 10/2009 |
| JP | 2009263853 | A | 11/2009 |
| WO | 2009126106 | A1 | 10/2009 |
| WO | 2010/092239 | A1 | 8/2010 |
| WO | 2010092239 | A1 | 8/2010 |
| WO | 2011064441 | A1 | 6/2011 |
| WO | 2014029916 | A1 | 2/2014 |

OTHER PUBLICATIONS

Aug. 8, 2014 International Search Report issued in International Patent Application No. PCT/FI2014/050367.
Jun. 2, 2016 Office Action issued in Chinese patent application No. 201480027790.0.
Office Action from Chinese Application No. 201480027790.0 dated Jun. 2, 2016.

* cited by examiner

METHOD FOR MAKING NANOFIBRILLAR CELLULOSE AND FOR MAKING A PAPER PRODUCT

FIELD OF THE INVENTION

This invention relates to a method for making nanofibrillar cellulose. The invention also relates to a method for making a paper product.

BACKGROUND OF THE INVENTION

Cellulose, which is an abundant natural raw material, is a polysaccharide consisting of a linear chain of several hundreds to ten thousand linked D-glucose units. Cellulose fibers can be refined with a refiner or a grinder to produce nanofibrillar cellulose material. Typically, the production of nanofibrillar cellulose material requires a significant amount of energy for mechanically disintegrating fibers to the size of fibrils. Therefore, there may be an efficiency problem with said material production.

It is known to use nanofibrillar cellulose as additive in papermaking by adding it to the aqueous furnish from which the paper will be made by dewatering and drying. The manufacture of nanofibrillar cellulose is demanding and requires special equipment in the paper mill, when nanofibrillar cellulose is to be used in the furnish from which the paper product will be made.

SUMMARY OF THE INVENTION

The present invention discloses a method for manufacturing pulp comprising fibril cellulose. In addition, the invention discloses a method for making paper product comprising nanofibrillar cellulose.

Anionized or cationized cellulose fibers are refined together with cellulose pulp in a proportion where cellulose pulp acts as auxiliary pulp, and the anionized or cationized cellulose fibers are disintegrated into nanofibrillar cellulose at least partly in the process where mechanical energy is brought to the mixture by refining. The cellulose pulp can be mechanical pulp or chemical pulp or mixture of these. The resulting mixture of the nanofibrillar cellulose and the cellulose pulp that has undergone the refining stage is added to other papermaking fibers when preparing the furnish for paper production.

The method comprises preparing a mixture of anionized or cationized cellulose fibers and the cellulose pulp, a refining stage where the said mixture is refined by using energy which disintegrates the anionized or cationized cellulose fibers at least partly to the size of nanofibrillar cellulose, and a mixing stage where the mixture is mixed with the other fibrous constituents of the furnish, from which the paper product is made.

In the refining stage, available refining equipment of the paper mill can be used. The mixture of the anionized or cationized cellulose fibers and the auxiliary pulp can pass several times the refiner, until the anionized or cationized cellulose fibers are reduced to the size of fibrils to the desired extent, resulting in a mixture of nanofibrillar cellulose and pulp fibers, which are also refined but not reduced to the size of fibrils. The disintegration of the anionized or cationized fibers is based on the weakening of the internal strength of the fiber due to the existence of ionic (anionic or cationic) groups in the cellulose, causing the release of fibrils from the fibrous structure by the effect of mechanical energy, while the pulp remains as fibers.

In the refining stage, the auxiliary pulp is used in the proportion of at least 1 wt-% and less than 90 wt-% of the total weight of the pulp (anionized or cationized fibers+ auxiliary pulp), calculated as dry weight. The amount of anionized fibers is preferably above 10 wt-% and 60 wt-% at the most, more preferably 50 wt-% at the most, and most preferably 15-50 wt-% of the total weight of the pulp, as dry weight.

The auxiliary pulp helps to control the refining process by stabilizing the mixture between the refiner surfaces, because the anionized cellulose fibers turn gradually into a gel of nanofibrillar cellulose which has no strength at the high shear forces of the refiner. Unexpectedly, as the gelling proceeds due to the formation of nanofibrillar cellulose, the gap between the refining surfaces (blade gap) can be increased with constant refining power as the refining energy used increases (is cumulated).

Typically, specific energy consumption (SEC) of 300-1500 kWh/t pulp is applied in the refining stage to the mixture of anionized or cationized cellulose fibers and auxiliary pulp. The SEC is preferably not higher than 1000 kWh/t pulp. Most preferably the SEC is 500-800 kWh/t pulp.

The refiner can be a device that is used normally in the refining (beating) of pulp to achieve a desired beating degree, such as disc refiner, double disc refiner, conical refiner or a cylindrical refiner.

After the refining stage, the mixture of nanofibrillar cellulose and cellulose pulp (auxiliary pulp) is combined with additional pulp (base pulp) for making the furnish for papermaking. The mixture of nanofibrillar cellulose and auxiliary pulp can constitute an additive fibrous component whose amount is less than the amount of the base pulp, which constitutes the main fibrous component of the paper. This additive fibrous component can be added in the proportion to achieve the nanofibrillar cellulose amount of 0.1-5.0%, more preferably between 0.3 and 4%, and most preferably between 0.5 and 2% (dry weight) of the manufactured furnish. The amount of 0.5-1.0% is usually already sufficient for the effect of NFC. The amount is calculated from the whole furnish, including the fibrous components (fibers and nanofibrillar cellulose), the possible filler and possible other additives. When the mixture of NFC and auxiliary pulp is used for making furnish, from which paper products are made, the NFC is preferably anionic because of other additives in the furnish, that is, anionized cellulose fibers are used for the refining together with the auxiliary pulp.

The mixture of nanofibrillar cellulose and auxiliary pulp from the refining stage is supplied to the flow of base pulp in a paper mill at any suitable location before the paper machine, preferably before the pulp is diluted in the paper machine approach system. The mixture can be supplied to the base pulp before a beating process of the base pulp to mix it with the base pulp in the beating, or after the beating process in a suitable mixing chest.

As to the auxiliary pulp and base pulp, all pulp grades suitable for manufacture of paper products can be used. The auxiliary pulp and the basic pulp can have the same constitution (for example from a common pulp source) or they can be different. Mechanical pulp and/or chemical pulp can be used. The cellulose in these pulp grades is chemically unmodified, in contrast to the anionized cellulose fibers, which are the raw material for the nanofibrillar cellulose.

Paper product means in this context both paper and board grades. Corresponding expressions paper machine and paper mill shall be interpreted to refer to board machines and board mills as well. The invention is suitable for manufacturing various grades in a wide basis weight range.

The method provides a way to manufacture nanofibrillar cellulose and to incorporate it in paper furnish with increased production efficiency. Free capacity of refiners in a paper mill can be used for manufacturing the nanofibrillar cellulose continuously or batchwise in a paper mill, by repeating the refining in sufficient number of passes through the refining gap of the device. Nanofibrillar cellulose as such may provide a paper product with new functional properties. Moreover, due to the present invention, it may be possible to achieve a simple nanofibrillar cellulose manufacturing process with low energy consumption. The produced pulp comprising fibril cellulose may be used, for example, as a strength additive for a paper product.

The anionized cellulose fibers are pulp fibers where the cellulose is modified chemically so that the cellulose molecules comprise anionic groups predominantly at the C6 carbons. The modification may be made catalytically in N-oxyl mediated cellulose oxidation using a suitable oxygen source (oxidant), one example being oxidation by known "TEMPO" catalyst. The catalytic oxidation creates carboxylate groups in the cellulose. The modification may be also made chemically by carboxymethylation, which creates carboxymethyl groups in the cellulose. In both cases the anionic groups of cellulose weaken the internal bonds of the cellulose fiber, which contributes to the release of fibrils from the fiber by mechanical energy. The susceptibility to fibril release can be adjusted by the conversion degree or "charge" (often expressed by mmol anionic groups/g pulp). The increase of charge of cellulose also brings about the increase of charge of cellulose fibrils, and hence, the repulsion forces between fibrils of the cellulose fiber increase.

The same effect as above can be attained when the cellulose in the pulp fibers is modified chemically so that the cellulose molecules comprise cationic groups. The cationization can be effected for example by linking quarternary ammonium groups to the cellulose molecules.

Because the manufacturing process of nanofibrillar cellulose can be integrated in the stock preparation system of the paper mill using the capacity of existing refining equipment, the method may significantly simplify the start-up of nanofibrillar cellulose usage, because some large investments, such as installation of special nanofibrillar cellulose producing machinery and equipment for handling and transporting gel of nanofibrillar cellulose, may be avoided.

DESCRIPTION OF THE DRAWINGS

In the following, the invention will be illustrated by drawings in which.

DETAILED DESCRIPTION OF THE PREFERRED EMBODIMENTS

Figure 1:
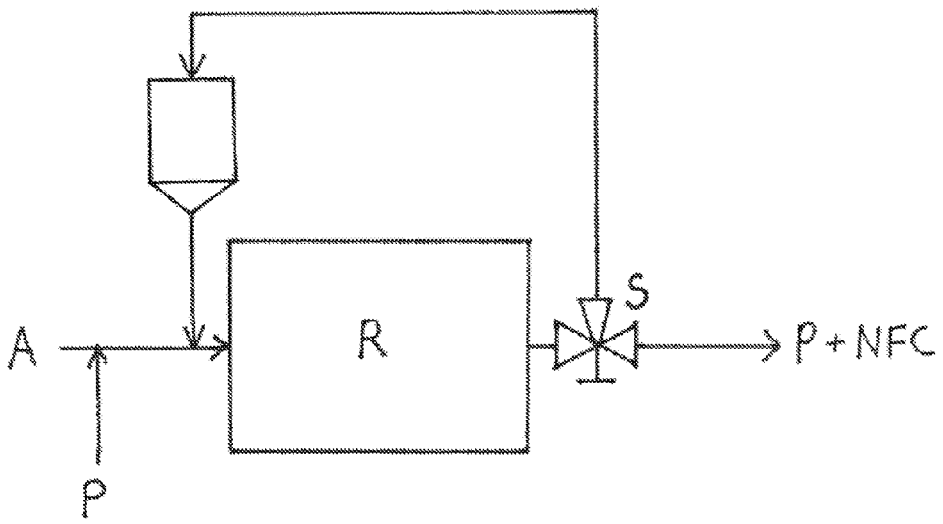
FIG. 1 shows the method according to one embodiment

In the present application, all percentages are by dry weight, if not indicated otherwise.

In the present application, all results shown and calculations made, whenever they are related to the amount of pulp, are made on the basis of dried pulp.

In the present application, the term "fibrous component" or "fibrous material" is a common designation for material in the form of fibers and material derived from fibers, such as fibrils.

Cellulose is a renewable natural polymer that can be converted to many chemical derivatives. The derivatization takes place mostly by chemical reactions of the hydroxyl groups in the β-D-glucopyranose units of the polymer. By chemical derivatization the properties of the cellulose can be altered in comparison to the original chemical form while retaining the polymeric structure.

Both the cellulose pulp used as the auxiliary pulp in the refining stage and the basic pulp can be from any cellulose raw material source that can be used in the production of chemically and/or mechanically treated cellulose fibers, known as "chemical pulping" and "mechanical pulping", respectively. The raw material can be based on any plant material that contains cellulose. The plant material may be wood. The wood can be from softwood trees such as spruce, pine, fir, larch, douglas-fir or hemlock, or from hardwood trees such as birch, aspen, poplar, alder, eucalyptus or acasia, or from a mixture of softwood and hardwood. Nonwood material can be from agricultural residues, grasses or other plant substances such as straw, leaves, bark, seeds, hulls, flowers, vegetables or fruits from cotton, corn, wheat, oat, rye, barley, rice, flax, hemp, manila hemp, sisal hemp, jute, ramie, kenaf, bagasse, bamboo or reed.

The term "chemical (cellulose) pulp" refers to cellulose fibers, which are isolated from any cellulose raw material or any combination of cellulose raw materials by a chemical pulping process. Therefore, lignin is at least for the most part removed from the cellulose raw material. Chemical pulp is preferably sulfate wood pulp. In an example, the chemical pulp is isolated from softwood and/or from hardwood. The used chemical pulp may be unbleached or bleached. Typically, the diameter of the fibers varies from 15 to 25 μm and the length exceeds 500 μm, but the present invention is not intended to be limited to these parameters.

The term "mechanical (cellulose) pulp" refers to cellulose fibers, which are isolated from any cellulose raw material by a mechanical pulping process. The mechanical pulping process could be preceded by a chemical pretreatment, producing chemimechanical pulp.

The auxiliary pulp used in this invention can be any pulp used in the paper manufacture. It can comprise mechanically and/or chemically and/or chemi-mechanically treated cellulose fibers, or recycled fibers. Therefore, the auxiliary pulp may consist of chemical cellulose pulp (hardwood or softwood chemical pulp), or mechanical pulp, chemi-mechanical pulp, recycled pulp, or of any mixture of these.

When the auxiliary pulp is refined together with anionized cellulose fibers and the obtained mixture is combined with base pulp and other constituents, such as filler, a furnish is obtained which is used for papermaking in the form of aqueous fibrous suspension, which is dewatered and dried in the paper machine. The constituents of the furnish will become the constituents of the paper, and the nanofibrillar cellulose is thoroughly mixed in the paper structure among the structural fibers of the paper, which consist of the auxiliary pulp and the base pulp, and among the possible filler. The nanofibrillar cellulose improves the bonding strength properties, improves the wet web tensile index and lowers the air permeablity properties of the paper product, compared with paper with the same composition but without nanofibrillar cellulose.

It is possible to use nanofibrillar cellulose in mechanical pulp containing papers, such as printing paper. The method may be used, for example, in Light Weight Coated (LWC) or Super Calendered (SC) papers. Advantageously the method is used in paper grades having high chemical pulp share, i.e. in papers comprising more chemical pulp than mechanical pulp. In an embodiment, at least 80% of dry weight, more preferably at least 90% of dry weight and most preferably at least 95% of dry weight of the cellulose fibers used in this invention is from chemical pulp.

The term "nanofibrillar cellulose" refers to a collection of isolated cellulose microfibrils or microfibril bundles derived from cellulose raw material. There are several widely used synonyms for nanofibrillar cellulose (NFC), for example: nanofibrillated cellulose, nanocellulose, microfibrillar cellulose, cellulose nanofiber, nano-scale fibrillated cellulose, microfibrillated cellulose (MFC), or cellulose microfibrils. Fibril cellulose described in this application is not the same material as the so called cellulose whiskers, which are also known as: cellulose nanowhiskers, cellulose nanocrystals, cellulose nanorods, rod-like cellulose microcrystals or cellulose nanowires. In some cases, similar terminology is used for both materials, for example by Kuthcarlapati et al. (Metals Materials and Processes 20(3):307-314, 2008) where the studied material was called "cellulose nanofiber" although they clearly referred to cellulose nanowhiskers. Typically these materials do not have amorphous segments along the fibrillar structure as fibril cellulose, which leads to a more rigid structure. Cellulose whiskers are also shorter than fibril cellulose.

The anionization of the cellulose fibers, preferably chemical pulp, is preferably implemented by a reaction wherein primary hydroxyl groups of cellulose are oxidized catalytically by a heterocyclic nitroxyl compound. Other heterocyclic nitroxyl compounds known to have selectivity in the oxidation of the hydroxyl groups of C-6 carbon of the glucose units of the cellulose can also be used.

The charge (oxidation level) of the anionized cellulose fibers is preferably between 0.5 and 1.2, for example between 0.9 and 1.1 mmol COOH/g pulp. When the anionized cellulose is to be used in paper products, the charge can be even lower, between 0.6-0.8 mmol COOH/g pulp.

The term "oxidation of cellulose" refers to the oxidation of the hydroxyl groups (of cellulose) to aldehydes and/or carboxyl groups. Although in some applications it is preferred that the hydroxyl groups are oxidized to carboxyl groups, i.e. the oxidation is complete, it is preferable that the cellulose also comprises aldehyde groups as a result of the oxidation, if the anionized cellulose is to be used in paper products. After the refining step in a refiner, the NFC consequently comprises also aldehyde groups, in addition to carboxyl groups. The aldehyde groups are beneficial for the wet strength in the manufacture of paper products. "Catalytic oxidation" refers to N-nitroxyl-mediated (such as "TEMPO"-mediated) oxidation of hydroxyl groups. The term "TEMPO" refers to "TEMPO" chemical, i.e. 2,2,6,6-tetramethylpiperidinyl-1-oxy free radical, a common catalyst in the oxidation of cellulose.

The catalytic oxidation of cellulose fibers by nitroxyl-mediated (such as "TEMPO"-mediated) oxidation produces fibers where some hydroxyl groups of cellulose are oxidized to carboxylate groups, and, as stated above, incompletely to aldehyde groups, if the oxidation is not brought to completion. The term "anionized cellulose fibers" refers to a material comprising at least 90 w-% (of dry weight) cellulose material, more preferably consisting of cellulose material, in which cellulose is oxidized by N-nitroxyl-mediated (such as "TEMPO"-mediated) oxidation of hydroxyl groups of the cellulose.

Thus, to produce anionized cellulose fibers, chemical pulp, which may be produced from softwood and/or from hardwood, is oxidized in the catalytic oxidation, such as N-nitroxyl-mediated oxidation. The anionized cellulose fibers have a high anionic charge and, thus, said anionized cellulose fibers are relatively easily disintegrated to fibrils under shear forces.

The anionization of the cellulose fibers, preferably chemical pulp, can also be implemented by carboxymethylation, which is a chemical treatment method. Carboxymethylated cellulose fibers have carboxymethyl (CM) groups in the cellulose molecules, and the fibers can be disintegrated to fibrils under shear forces due to the weakened internal bonds of the cellulose in the same way as the oxidized cellulose. The modification degree of the carboxymethylated cellulose can be characterized by charge, which is preferably 0.5-1.2 mmol CM groups/g pulp.

Thus, the term "anionized cellulose fibers" can also refer to a material comprising at least 90 w-% (of dry weight) cellulose material, more preferably consisting of cellulose material, in which cellulose is carboxymethylated at hydroxyl groups of the cellulose. Chemical pulp, which may be produced from softwood and/or from hardwood, can be carboxymethylated in a chemical treatment to produce anionized cellulose fibers.

According to FIG. 1, anionized cellulose fibers A and the auxiliary pulp P can be fed to the inlet of the refiner R, which can be any of the above-mentioned types. The mixture of the auxiliary pulp and the anionized fibers is continuously circulated from the outlet of the refiner through an intermediate storage tank to the inlet while fresh mixture is continuously supplied to the inlet. Predetermined portion of the mixture of auxiliary pulp and the anionized fibers is continuously withdrawn from the circulation by a separator S after the outlet of the refiner R, and it is fed further to the papermaking process. The proportion is selected so that the anionized fibers will attain a sufficient beating degree while circulating through the refiner. The separator S can be a simple directional valve, where the proportion can be set.so that the mixture will circulate a required number of passes. The mixture of auxiliary pulp and nanofibrillar cellulose, P+NFC, exits the separator S.

Figure 2:
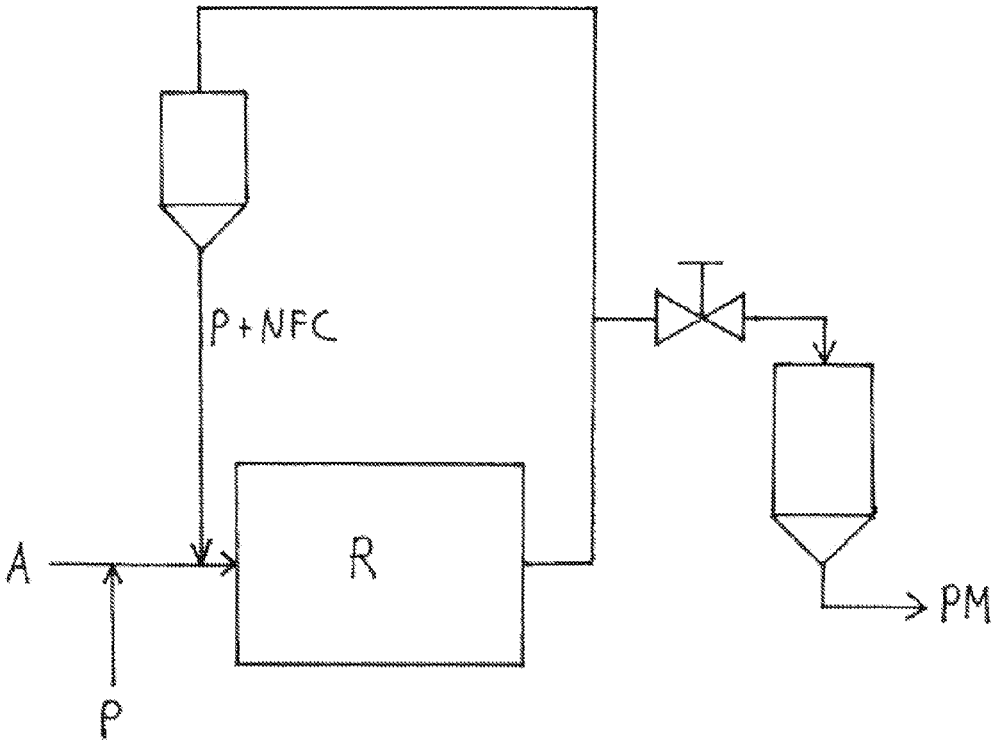
FIG. 2 shows the method according to another embodiment.

In FIG. 2, anionized cellulose fibers and the auxiliary pulp are fed to the refiner as above. The process operates in a batch mode, that is, the mixture is circulated through the refiner in sufficient number of passes to reach the desired beating degree, whereafter the mixture is passed to an intermediate storage tank, whose contents are supplied continuously to the papermaking process PM.

In the arrangements of FIGS. 1 and 2, the intermediate storage tank is not necessarily required, but the mixture can be circulated directly to the inlet of the refiner.

Figure 3:
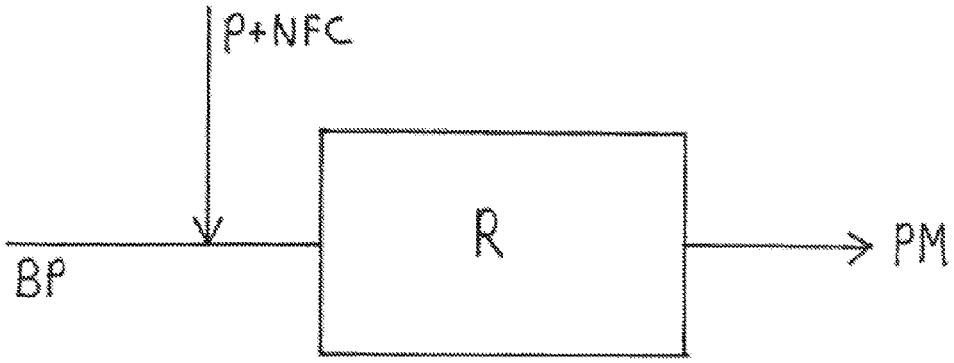
FIG. 3 shows mixing of nanofibrillar cellulose with the basic pulp in paper manufacture.

In FIG. 3, the addition of the nanofibrillar cellulose to the base pulp before the paper machine is shown. The mixture of nanofibrillar cellulose and the auxiliary pulp P+NFC which is obtained as in FIG. 1 or 2 or in any other way is fed continuously to the flow of base pulp BP before the beating step (refiner R) of the base pulp. In this step the auxiliary pulp and nanofibrillar cellulose become well dispersed among the base pulp BP and consequently in the structure of the paper manufactured from the furnish. Alternatively, the mixture of nanofibrillar cellulose and the auxiliary pulp can also be supplied to the basic pulp after the refiner. In this case, the mixture can be added to the base pulp in a suitable mixing arrangement, for example in a mixing chest.

Other additives, such as filler and/or cationic polyelectrolyte, such as cationic starch, can also be added to the furnish.

The mixture of the anionized cellulose fibers and the auxiliary pulp is subjected to refining as a relatively dilute aqueous suspension, preferably in a consistency of 1-10%, preferably 2-6%, which are typical values for LC refining. The mixture that has undegone the refining stage is supplied preferably in the same consistency to the base pulp.

It is also possible that the mixture is refined in a higher consistency in a HC refiner. The auxiliary pulp can be TMP reject. Thus, the refining can be performed as TMP reject refining, for example in a consistency of 25-45%, which is typically used in refining TMP reject. It is possible that after the refining the mixture of the NFC and TMP is diluted before it is mixed with the base pulp.

The amount of the nanofibrillar cellulose in the manufactured paper furnish is preferably between 0.1 and 5.0%, more preferably between 0.3 and 4%, and most preferably between 0.5 and 2% of dry weight of the manufactured furnish. Often the amount in the range of 0.5-1.0% is already sufficient. The amount is calculated from the whole furnish, including the fibers and other constituents, such as possible filler.

Cationic polyelectrolyte, such as starch, is preferably dosed to the base pulp before the supply of nanofibrillar cellulose and auxiliary pulp. Cationic polyelectrolyte can be any retention or strength polymer used in paper manufacturing, e.g. cationic starch, cationic polyacrylamide (CPAM) or polydimethyl-diallyl ammonium chloride (PDADMAC). Also, the combinations of the different polyelectrolytes can be used. Preferably, the cationic polyelectrolyte is cationic starch (CS). The cationic polyelectrolyte is added in an amount of 0.01 to 5% of dry weight of fibers in the furnish, preferably approximately 0.10 to 1.00% of dry weight.

In refining tests performed with the mixture of anionized cellulose fibers and auxiliary pulp, anionized cellulose fibers were "TEMPO"-oxidized fibers, and the auxiliary pulp was harwood (birch) chemical pulp. In Auxiliary pulp and anionized cellulose fibers were used in proportions 80/20 and 67/33 (w/w), that is, the amount of auxiliary pulp was greater in the mixture. The reference was pure auxiliary pulp. The refiner used was a conical refiner (Voith LR1 laboratory refiner, which simulates well refining in a paper mill), where the refining was repeated for the same material several times. The refiner blades had grooves and bars (blade edges).

The refining process was automatic. The mass flow through the refiner and the power of the refiner were set as constant, and the blade gap was adjusted during the refining by the power control. It was noticed that after a certain cumulated refining energy had been attained (after sufficient number of passes through the refiner), the blade gap started to increase (the distance of the blades increased). The auxiliary pulp helps to maintain the blade gap in the beginning of the refining stage, and even if the blade gap grows in course of the process as the number of passes increase, the refining power remains approximately the same. This could not be observed with reference pulp, which was refined with decreasing blade gap. By refining the mixture of auxiliary pulp and anionized or cationized cellulose fibers, the risk of blade contact decreases as the refining proceeds towards the target energy consumption, which is unique.

Blade patterns of the refiner (for example form and width of the grooves and bars in the opposing blades) can be used to further improve the refining process. The results can also be improved by controlling the flow of the mixture with respect to the blade patterns.

The refining tests are described in more detail below.

The laboratory refiner was equipped with a fibrillating conical plate, bar width 3 mm and groove width 5 mm, with a cutting angle of 60°, and with a cutting edge length of 2.43 km/s at rotation speed of 3000 rpm.

The refining proceeded through five energy levels, 100, 200, 300, 400, and 500 kWh/ton for different pulp mixtures. The compositions of the pulps are presented in the table below. Further, mixing tests were performed with nanofibrillar cellulose fabricated in advance. The following materials were used:

An ionized cellulose fibers (TEMPO-oxidized), oxidation degree 0.95-1.05 mmol COOH/g pulp (aldehyde groups 0.1-0.2 mmol/g pulp).

Cellulose pulp used as auxiliary pulp and as reference was chemical pulp made of birch.

Ready made nanofibrillar cellulose used in mixing tests was gel at a consistency of 2.5%, with Brookfield viscosity of 24450 mPa·s and turbidity of 19 NTU. The oxidation degree was 0.95 mmol COOH/g pulp.

| | Birch pulp g | Water l | Anionized fiber or NFC g |
|---|---|---|---|
| REFINING TESTS | | | |
| Reference | 1200 g | 37.5 | 0 |
| Mixture | 1200 g | 37.5 | 300 |
| Mixture | 1200 g | 37.5 | 600 |
| MIXING TESTS | | | |
| Mixing | 80 g ref. pulp refined 500 kWh/t | 2.5 | 20 |
| Mixing | 80 g ref. pulp refined 500 kWh/t | 2.5 | 40 |

In all tests, the consistency of auxiliary pulp was 3.2%. In tests where anionized fibers were refined together with auxiliary pulp, the consistency of the anionized fiber fraction was 0.8 and 1.6%, and the amount of the anionized fibers were 20% and 33% of the total amount of pulp (auxiliary pulp+anionized pulp).

The results showed that with reference pulp (no anionized fibers), the blade gap increased as a function of net refining energy. With pulps containing anionized fibers, the blade gap started to grow after a certain net energy amount, and this started earlier with a higher proportion of anionized fibers. With the proportion of 20%, the increase of the blade gap started after about 250 kWh/t, whereas with a higher proportion of 33%, the increase started already at 150 kWh/t.

The following table shows the results of samples taken from the tests at different net energies. It is noteworthy that the viscosities of the samples from refining together with anionized fibers was clearly higher than the viscosity of the sample from reference, which was a clear indication of the formation of NFC.

| | | Reference 200 kWh/t | 500 kWh/t | Birch + Anionized fiber 20% 200 kWh/t | 500 kWh/t | Birch + Anionized fiber 33% 200 kWh/t | 500 kWh/t | Birch 500 kWh/t + Anionized fiber 20% Mixing | Birch 500 kWh/t + Anionized fiber 33% Mixing |
|---|---|---|---|---|---|---|---|---|---|
| pH | | | 5.0 | | 6.1 | | 6.5 | 6.3 | 6.8 |
| FiberLab mm | | | | | | | | | |
| Conductivity | mS/m | 3.29 | 5.50 | 15.0 | 14.3 | 24.1 | 25.3 | 19.4 | 35.5 |
| Charge | mekv/l | | −0.185 | | −0.959 | | −1.714 | −1.109 | −2.366 |
| Turbidity | NTU | | 22 | | 20 | | 44 | | |
| Viscosity FC Brookfield 10 rpm (1.5%) | mPas | | 6788 | | 14474 | | 13077 | 12049 | 22241 |

The lower viscosity value at higher proportion of anionized fibers may be due to insufficient energy, and higher energy input may result in higher viscosity.

Figure 4A:
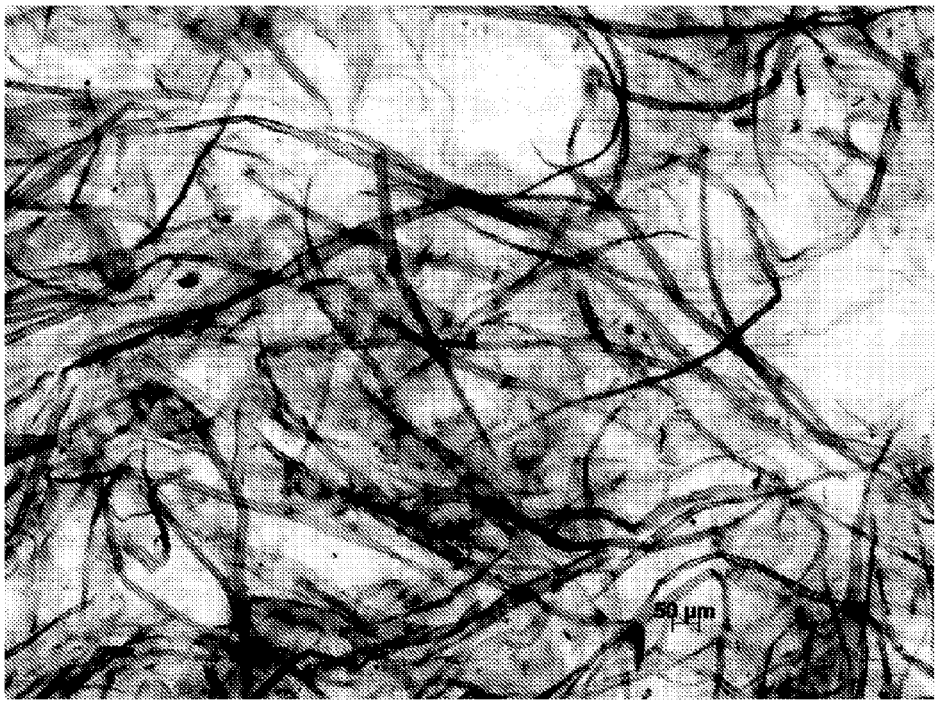
FIGS. 4*a*-4*d* are microscope images of various mixtures.
Figure 4B:
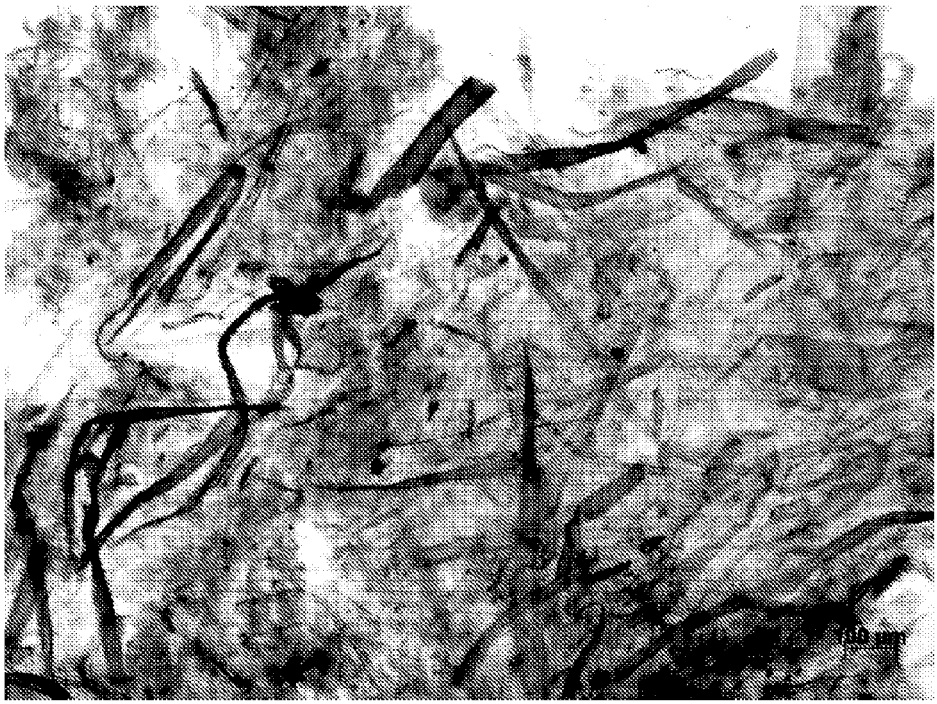
Figure 4C:
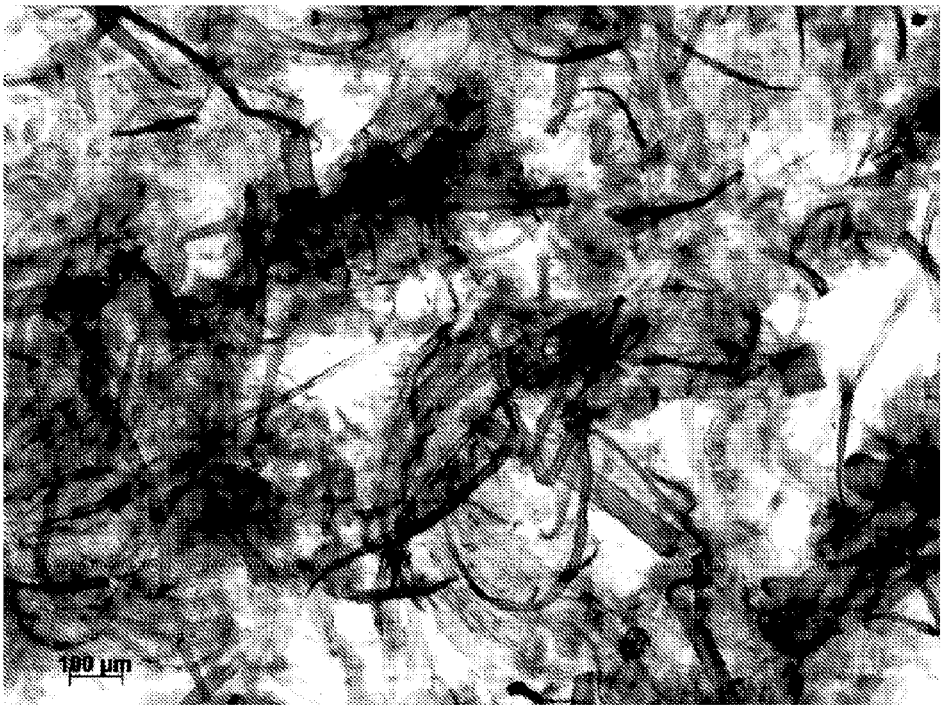
Figure 4D:
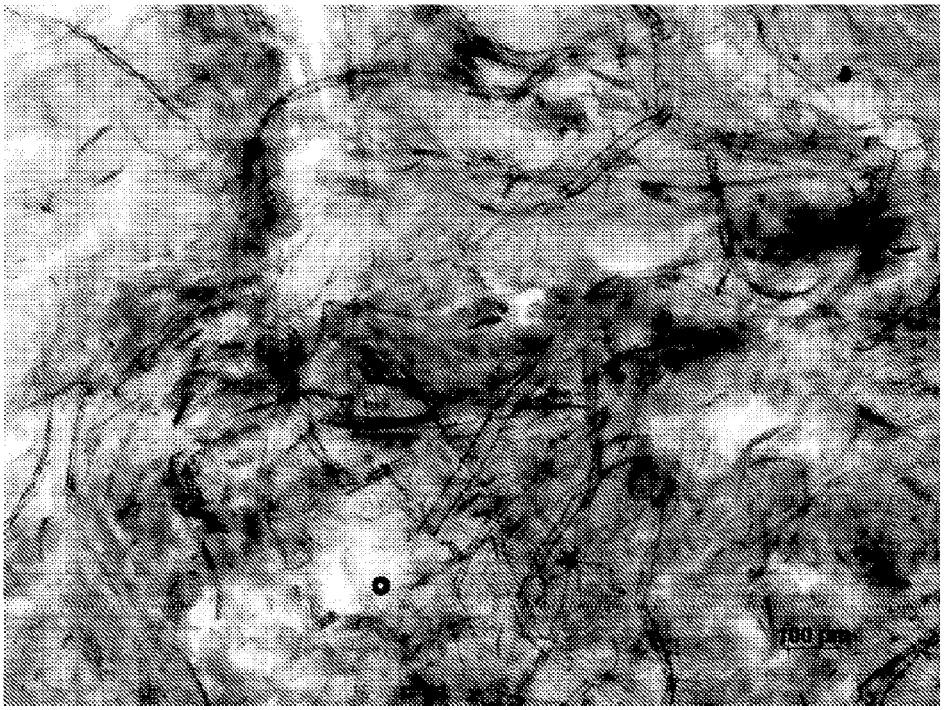

The existence of NFC in the mixture after the refiner can be evidenced by the microscope images 4*a*-4*d*. The samples obtained form the refining were dyed with toluidine blue, which dyes the cellulose with carboxylate groups dark violet but leaves fibers with unmodified cellulose almost colorless. Reference pulp is shown by FIG. 4*a*. The spreading of color, a sort of "staining" of the background is clearly seen in samples where the proportion of oxidized fiber was initially 20% (4*b*) and 33% (4*c*), indicating the spreading of fibrils where the cellulose contains carboxylic groups. In the sample obtained by mixing NFC to the pulp (FIG. 4*d*), a similar spreading of violet color can be seen.

According to the present method, it is also possible to avoid transportation of low solids nanofibrillar cellulose having the consistency of 5% at the most. In nanofibrillar cellulose production, the concentration of fibril cellulose in dispersions is typically very low, usually around 1-3%. Therefore the logistic costs are typically too high to transport the material from the production site. The specific surface area of fibril cellulose is very large due to its nanoscopic dimensions, and concentration or drying of fibril cellulose hydrogel is challenging. Respectively, strong water retention is natural for nanofibrillar cellulose since water is bound on the surfaces of the fibers through numerous hydrogen bonds. Therefore, the anionized cellulose fibers can be supplied to the paper mill in concentrated form and made to NFC at the paper mill by refining the fibers together with auxiliary pulp.

According to the present method, the nanofibrillar cellulose may be produced in the paper mill, i.e. in "on-site fibril cellulose production", even without need for complicated dosing aggregates in the paper machine approach system. Only storage tank, dilution water and dosing pumps are needed to feed the anionized cellulose fibers and auxiliary pulp to the refiner. Because the NFC is in gel form in the mixture of nanofibrillar cellulose and auxiliary pulp, a pump capable of pumping viscous masses is needed to pump the mixture to the base pulp. A progressive cavity pump, also known as eccentric screw pump or "Mono pump", which is a helical rotor pump which operates on the positive displacement principle, is preferably used.

A paper produced from the furnish containing NFC and manufactured according to the method may have many advantages. For example, the grammage of the paper may be decreased and/or the amount of the filler in use may be increased and/or strength properties of the produced paper may be increased. In addition, if the paper is release paper, the amount of the needed silicone coating on the release paper to make a release liner for a label laminate may be decreased due to the properties of the produced paper.

The paper product can also be printing paper, sandpaper base, packing material, or cardboard.

Advantageously, the basis weight range of the manufactured paper is between 30 and 90 g/m$^2$, more preferably between 30 and 50 g/m$^2$. The produced paper may be coated and/or surface sized and/or calendered. For sandpaper base and packing material applications the basis weight may be higher than 90 g/m$^2$. For cardboard applications, the basis weight is usually at least 150 g/m$^2$.

The method can also be used for other purposes than for making paper products. In this case the cellulose fibers from which the NFC is obtained can be anionized or cationized. The product, which is a mixture of of nanofibrillar cellulose and the (auxiliary) cellulose pulp can be used for constructions, where the NFC portion acts as reinforcement. The product can be an intermediate product which can be made to final product by mixing it with other constituents.

The invention claimed is:

1. A method for making nanofibrillar cellulose or a product comprising the same, the method comprising:

mixing anionized or cationized cellulose fibers and cellulose pulp to form a mixture comprising at least 1% and below 90 wt-% cellulose pulp based on dry weight, and subjecting the mixture to a refiner stage where the anionized or cationized cellulose fibers are at least partly reduced to nanofibrillar cellulose, and obtaining a mixture of nanofibrillar cellulose and cellulose pulp from the refining stage.

2. The method according to claim 1, wherein the anionized or cationized cellulose fibers include anionized fibers, and the amount of anionized fibers is above 10 wt-% and 60 wt-% at the most.

3. The method according to claim 1, wherein in the refining stage the mixture of anionized or cationized cellulose fibers and cellulose pulp is passed several times through a refiner.

4. The method according to claim 1, wherein the anionized or cationized cellulose fibers include anionized fibers, and wherein the anionized cellulose is oxidized cellulose comprising carboxylate groups, or carboxymethylated cellulose.

5. The method according to claim 1, wherein the cellulose pulp comprises chemical pulp.

6. The method according to claim 1, further comprising, after the refining stage, combining the mixture of nanofibrillar cellulose and cellulose pulp with additional pulp.

7. The method according to claim 6, further comprising supplying the mixture of nanofibrillar cellulose and cellulose pulp to a flow of the additional pulp.

8. The method according to claim 6, wherein the product comprising nanofibrillar cellulose is a paper product.

9. The method according to claim 8, wherein the cellulose fibers include anionized cellulose fibers.

10. The method according to claim 8, further comprising supplying the mixture of nanofibrillar cellulose and cellulose pulp to a flow of the additional pulp before a beating step.

11. The method according to claim 8, further comprising supplying the mixture of nanofibrillar cellulose and cellulose pulp to a flow of the additional pulp in a proportion to achieve the nanofibrillar cellulose amount of 0.1-5.0% (dry weight) of the furnish from which the paper product is made.

12. The method according to claim 1, wherein the product comprising nanofibrillar cellulose is a paper product, and the mixture of nanofibrillar cellulose and cellulose pulp obtained from the refining stage is used for manufacturing the paper product.

13. The method according to claim 1, wherein the product comprising nanofibrillar cellulose is a paper product, further comprising mixing the mixture of nanofibrillar cellulose and cellulose pulp obtained from the refining stage with other constituents to make a final paper product.

14. The method according to claim 1, wherein the anionized or cationized cellulose fibers include anionized fibers, and the amount of anionized fibers is between 10 wt-% and 50 wt-%.

15. The method according to claim 1, wherein the anionized or cationized cellulose fibers include anionized fibers, and the amount of anionized fibers is between 15 and 50 wt-%.

16. The method according to claim 8, further comprising supplying the mixture of nanofibrillar cellulose and cellulose pulp to a flow of the additional pulp in a proportion to achieve the nanofibrillar cellulose amount between 0.3 and 4% (dry weight) of the furnish from which the paper product is made.

17. The method according to claim 8, further comprising supplying the mixture of nanofibrillar cellulose and cellulose pulp to a flow of the additional pulp in a proportion to achieve the nanofibrillar cellulose amount between 0.5 and 2% (dry weight) of the furnish from which the paper product is made.

18. The method of claim 1, wherein, during the refiner stage, the cellulose pulp is not reduced to fibril-size.

19. The method of claim 3, wherein, during the refiner stage, the cellulose pulp assists in controlling the refining process by stabilizing the mixture between surfaces of the refiner.

* * * * *